United States Patent [19]

Britzke et al.

[11] 4,346,533

[45] Aug. 31, 1982

[54] DRIVE FOR A VEHICLE DOOR

[75] Inventors: Ingo Britzke, Kassel; Manfred Horn, Kaufungen; Peter Gossmann, Grossalmerode, all of Fed. Rep. of Germany

[73] Assignee: Gebr. Bode & Co. GmbH, Kassel, Fed. Rep. of Germany

[21] Appl. No.: 191,768

[22] Filed: Sep. 29, 1980

[30] Foreign Application Priority Data

Apr. 26, 1980 [DE] Fed. Rep. of Germany ..... 3016174

[51] Int. Cl.[3] ..... E05F 15/10

[52] U.S. Cl. ..... 49/28; 49/110; 49/334; 49/338

[58] Field of Search ..... 49/28, 199, 26, 30, 49/338, 334, 109-111; 200/61.62, 47, 153 T, 61.21

[56] References Cited

U.S. PATENT DOCUMENTS

| | | | |
|---|---|---|---|
| 1,282,128 | 10/1918 | Rosentreter | 49/28 X |
| 2,223,637 | 12/1940 | Newkirk | 49/110 |
| 2,564,067 | 8/1951 | Karp | 49/30 |
| 2,606,022 | 8/1952 | Vanderveer et al. | 49/30 X |
| 2,751,219 | 6/1956 | Dodge | 49/28 X |
| 4,131,830 | 12/1978 | Lee et al. | 49/199 X |

*Primary Examiner*—Philip C. Kannan

*Attorney, Agent, or Firm*—Hane, Roberts, Spiecens & Cohen

[57] ABSTRACT

Obstacle sensing apparatus for a pivotal door has a drive for operating the door between open and closed positions. Linkage is provided between the pivotal column which supports the door for swinging movement and a platform pivotally mounted on a fixed adjacent structure. When an obstacle is encountered the reactive force pivots the platform through the linkage and activates switches which reverse the drive. Elastic blocks keep the platform centered except when an obstacle is encountered.

10 Claims, 8 Drawing Figures

DRIVE FOR A VEHICLE DOOR

BACKGROUND OF THE INVENTION

The invention relates to a drive for a vehicle door, wherein the door is moved out of the door opening with the aid of a turnable column mounted in a housing and having a centrally driven lever with an end connected to a transmission rod.

It is known that pivoting vehicle doors are articulated to a turnable column with the aid of pivot arms. If the column is turned, then an opening or closing movement of the door takes place.

To avoid accidents, the longitudinal sides of the door must be provided with arrangements which prevent a person possibly standing between the door leaves from becoming trapped.

For this purpose, control means are provided in the longitudinal sides of a pneumatically operated door which cause a direction change of the compressed air stream if an obstacle exerts pressure upon these control means. However, such a solution is relatively expensive.

An object of the invention is to so construct the drive for a vehicle door that the means for reversing the door movement becomes simpler and can be structurally united with the drive.

SUMMARY OF THE INVENTION

According to one embodiment of the invention this object is achieved in that a housing for the lever is arranged on an adjustable, particularly a tiltable plate and that switches are provided which are actuated during the adjusting movement of the plate.

In normal operation of the drive a usual turning of the turnable column and thus an opening and closing of the door takes place. If, however, an obstacle is encountered in the pivoting range of the door, then pressure is exerted upon the door which is transmitted to the lever. The lever has the tendency to pivot the door. Since it cannot do so because of the obstacle, the force exerted by the lever is transmitted to the housing. The housing is arranged on the tiltable plate so that the resulting force causes the plate to be displaced. During the displacement movement of the plate the switches are actuated, whereby control impulses are triggered which cause a reversal of the door movement.

According to another embodiment of the invention, the problem addressed by the invention is solved in that the housing is arranged on a plate which is located normal with reference to the axis of the lever and is elastically supported on a frame, and that switches are provided which are actuated during the displacement of the plate.

Here, also, it is assured that in the event of an obstacle in the pivot range of the door the lever exerts a corresponding reaction force on the housing and thus upon the plate, which is displaced due to its elastic support. This displacement movement is used to actuate switches which trigger appropriate control pulses and thus cause a door movement reversal.

According to another embodiment of the invention, the drive for actuating the door's turnable column is a piston drive with a cylinder which is articulately mounted by means of a holder, the holder being arranged on an adjustable, particularly a tiltable plate, and switches being provided which are actuated during the adjusting movement of the plate. Here, also, the presence of an obstacle causes the exertion of an appropriate reaction force upon the plate, whereby due to the movement of the same, switches are activated which trigger control pulses and thus cause a direction reversal of the door movement.

In the embodiments of the invention which operate with a tiltable plate the arrangement can be such that the plate itself has a tilting axis and that on opposite sides of this tilting axis restoring spring means are provided in order to restore the plate to its starting position. However, the tiltable plate must not absolutely be provided with a separate tilting axis; instead, the arrangement can also be such that the tiltable plate is supported on elastic supporting bodies so that a displacement is effected when forces act upon the plate.

To permit a tilting movement to be caused by the housing which carries the centrally driven lever, the housing is provided with an abutment at opposite sides of the axis of this lever with which it is supported on the tiltable plate. These abutments may be constructed as foot supports.

In the embodiment of the tiltable plate which is without a separate tilting axis, the tiltable plate is provided on its edge with a vertical wall portion which is guided by a guiding body, so that a type of pressure chamber is created, with elastic means, such as, e.g., rubber blocks or the like being provided between the guide body and the tiltable plate.

This construction of the tiltable plate assures a guidance of the plate during the tilting movement.

Although switches are provided on the tiltable plate, they may, however, also be provided on the housing which joins in the movement; what is necessary is that the switches are activated due to the displacement of the plate or of the housing.

BRIEF DESCRIPTION OF THE DRAWINGS

Other objects, the features and advantages of the invention will be apparent from the following detailed description which shows several embodiments of the invention.

IN THE DRAWING

Figure 1:
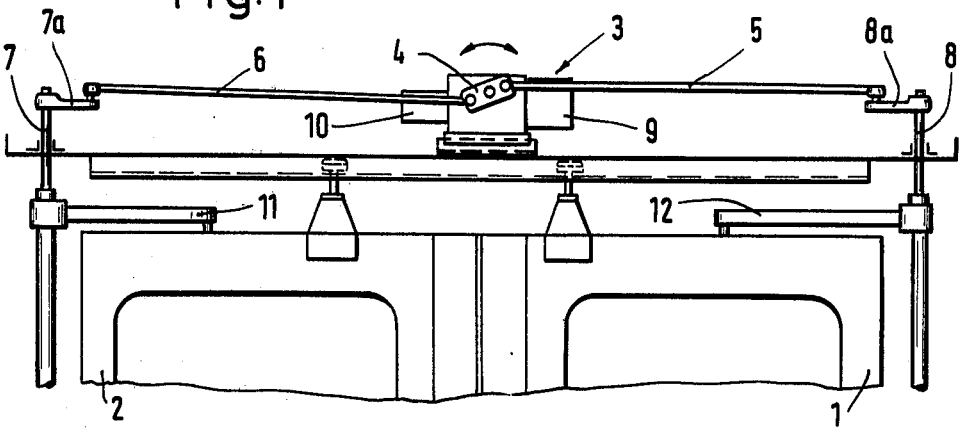
Figure 2:
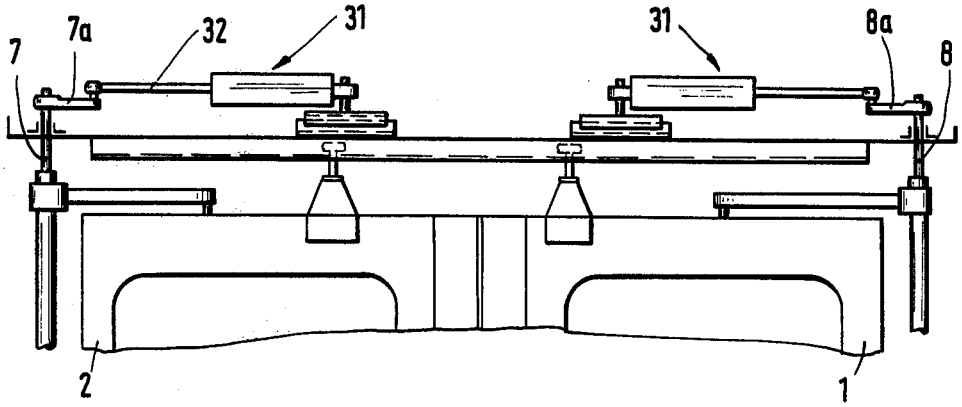
Figure 3:
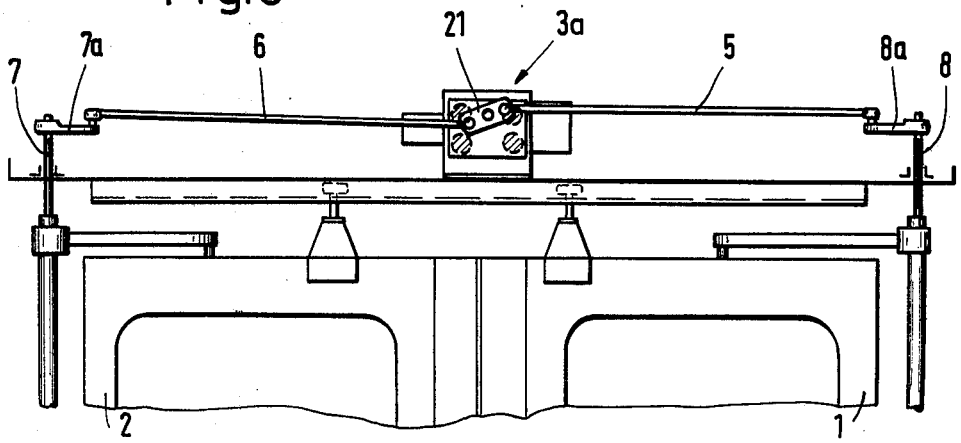
Figure 4:
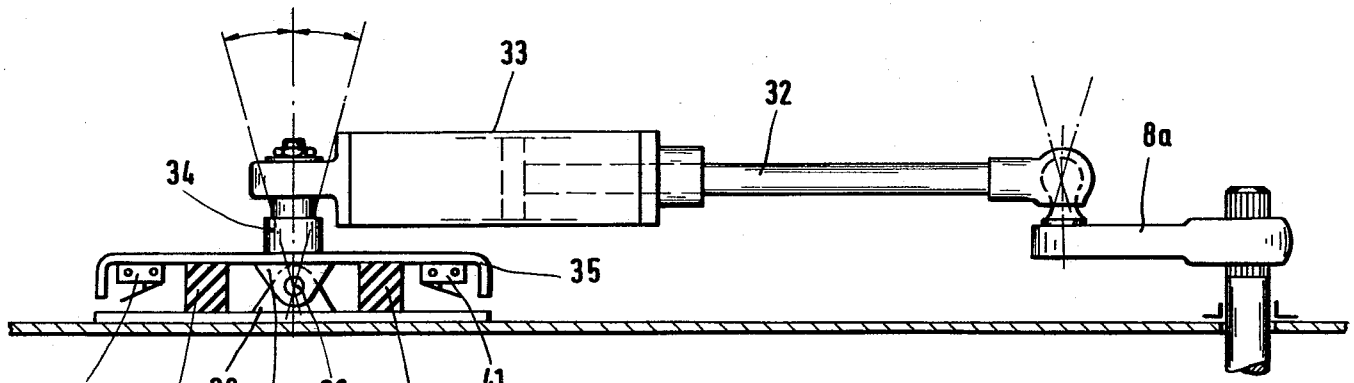
Figure 6:
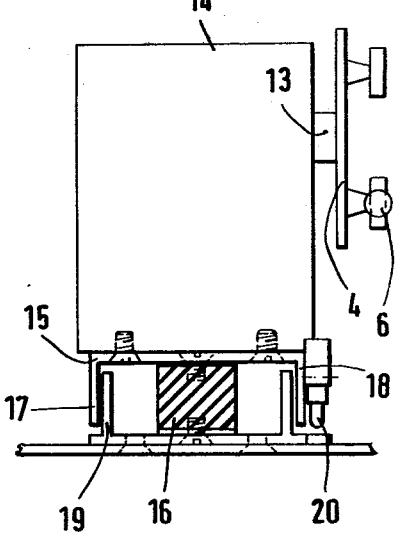
Figure 5:
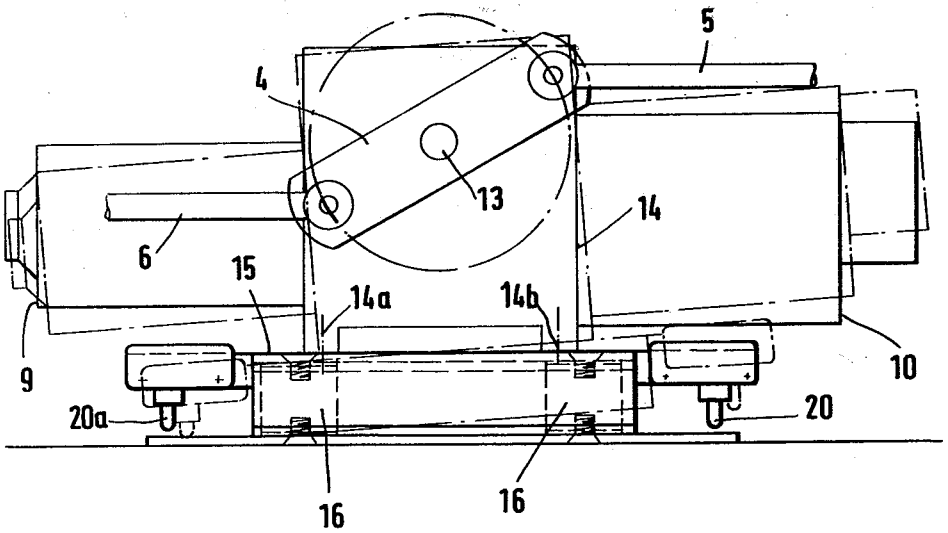
Figure 8:
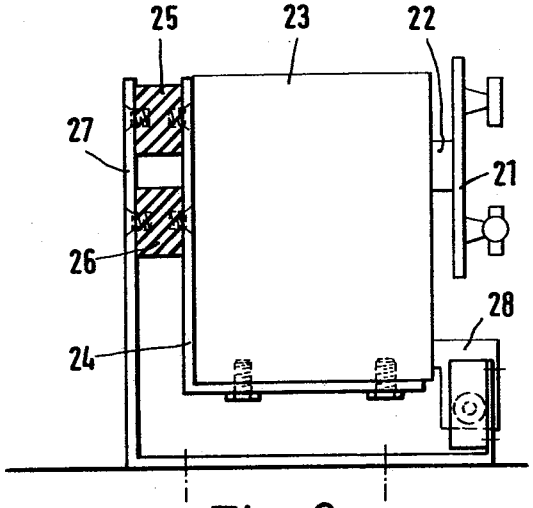
Figure 7:
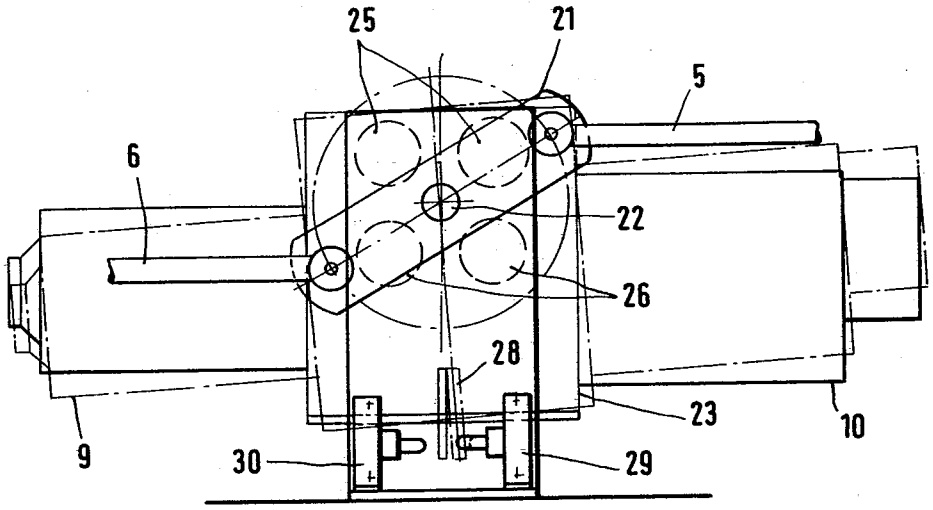

FIG. 1 shows the drive in the form of a centrally driven lever together with the pivoting door;

FIG. 2 shows the drive in the form of a cylinder and piston drive, together with the pivoting door;

FIG. 3 shows a different embodiment of the drive in the form of a centrally driven lever together with the pivoting door;

FIG. 4 shows the drive in the form of a cylinder and piston drive on an enlarged scale;

FIG. 5 shows the drive in the form of a centrally driven lever according to one of the embodiments of the invention;

FIG. 6 is a side view of the embodiment of FIG. 5;

FIG. 7 shows a different embodiment of the drive in the form of a centrally driven lever; and FIG. 8 is a side view of the embodiment of FIG. 7.

DETAILED DESCRIPTION OF THE PREFERRED EMBODIMENTS

In FIG. 1, a drive arrangement designated overall by reference numeral 3 is arranged above the pivoting doors 1 and 2 and includes a centrally driven lever 4 to which the transmission rods 5 and 6 are articulated. The rods 5 and 6 engage respectively an arm *7a* or *8a* provided on the turnable columns 7 and 8, respectively.

In operation the lever 4 is rotated in known manner with the aid of a rack that is driven by appropriate motors 9 and 10. Thus, the transmission rods 5 and 6 carry out an appropriate pushing or pulling movement, with the result that the arms 7*a* and 8*a*, respectively, are pivoted, causing the turnable columns 7 and 8, respectively, to be turned. The turning movement of the column 7 or 8 in turn causes a turning of the arms 11 and 12, respectively, on which the doors 1 and 2 are secured.

The drive arrangement 3 is illustrated in detail in FIGS. 5 and 6. The lever 4 which is centrally driven by means of the axle 13 carries the articulated transmission rods 5 and 6. The axle 13 is journalled in a housing 14 which is arranged on a tiltable plate 15.

For a tilting movement to be exerted by the housing 14 on the tiltable plate 15, the housing is provided at opposite sides of the axle 13 of the lever 4 with abutments 14*a* and 14*b* which in accordance with the exemplary embodiment may be constructed as foot supports.

The tilting movement of the tiltable plate is achieved, in this embodiment, in that the plate is supported on elastic supporting bodies 16. The construction is such, specifically, that the tiltable plate is provided with vertical wall portions 17,18 which are guided in the manner of a pressure chamber by a guide body 19. This construction guarantees a guidance of the tiltable plate during the tilting movement.

Switches 20, 20*a* are arranged on the tiltable plate 15. Two switches 20,20*a* are provided so that, depending upon whether the tilting movement is effected by the transmission rod 6 or by the transmission rod 5, a control impulse can be triggered.

It is also clear that the direction reversal of the doors is effected during the opening of the door as well as during the closing movement of the door. If, for example, during the pulling of the transmission rod 6 or 5 an obstacle is present in the tilting range of the door, then the switch 20*a* is activated. If a pressure force acts upon the transmission rod 5 or 6, then the switch 20 is activated.

FIGS. 7 and 8 show a different embodiment of the drive arrangement in the form of a centrally driven lever. FIG. 3 shows this drive arrangement 3*a* together with the doors 1,2 which are driven in the same manner as illustrated in FIG. 1. The lever has reference numeral 21; it is centrally driven by the axle 22, the same as is the case in the embodiment according to FIGS. 5 and 6.

The housing 23 which carries the axle 22 is secured on a plate 24 extending normal to the axle 22 and which is supported on a frame 27 by means of elastic blocks 25,26. The housing carries the activating element 28 which is located between two switches 29 and 30.

If an obstacle occurs in the swinging range of the door, for example during the pulling movement of the transmission rod 6, then the plate 24 to which the housing 23 is secured, is appropriately displaced with the result that the activating element 28 is also displaced and activates the switch 29 which causes reversal of the door movement.

The drive of the lever 21 is effected in known manner with the aid of a rack which is driven by the motor 9 and 10, as in FIG. 1, and as is also the case in the embodiment according to FIGS. 5 and 6.

A different embodiment of the drive arrangement is illustrated in FIG. 2. There, the drive arrangement includes a cylinder and piston drive identified in toto by reference numeral 31, the piston rod 32 of which acts upon the arms 7*a* 8*a*, respectively, as was the case in the embodiment according to FIG. 1.

FIG. 4 shows the drive on an enlarged scale. The cylinder 33 is articulately mounted on a holder 34. This holder is arranged on a tiltable plate 35. This tiltable plate 35 has a separate tilting shaft 36 which is journalled in appropriate journals 37 and 38. Restoring spring means 39 and 40 are arranged at opposite sides of the tilting shaft.

If an obstacle occurs in the swinging range of the door during the closing movement, then the piston rod 32 tends to continue to press upon the arm 8*a*. The result of this is that a corresponding reaction force acts upon the cylinder 33 so that the holder 34 transmits the force acting upon it to the tiltable plate 35 which becomes appropriately displaced. The switches 41,42 arranged on the tiltable plate yield appropriate control pulses which cause a direction reversal of the door movement.

The corresponding effect, but in opposite direction, occurs if during the opening movement of the door an obstacle is present in the pivot range of the door.

While only a limited number of embodiments have been shown and described in detail, there will now be obvious to those skilled in the art many modifications and variations satisfying the objects of the invention without departing from the spirit thereof as defined by the appended claims.

What is claimed is:

1. Apparatus for opening and closing a pivotal door by turning a rotatable drive column in respectively opposite directions, said appartus comprising drive means for rotating the drive column of the door in opposite directions, said drive means including a linkage member drivingly coupled to the rotatable drive column to turn the column in opposite directions to open and close the door, a platform connected to said linkage member, means supporting said platform from fixed structure for movement relative thereto when the door meets an obstacle, the platform being movable in opposite directions relative to the fixed structure in accordance with the direction of movement of the door when the door meets the obstacle in response to reactive forces, first and second resilient means for opposing movement of said platform in both directions, the arrangement of said first and second resilient means being such that movement of said platform in one direction produces stress of one of said resilient means in one direction and stress of the other of said resilient means in the other direction, both resilient means acting to return the platform to its initial position upon release of stress in the resilient means for either direction of movement of said platform, and control means for controlling the operation of the drive means and the rotation of said rotatable column comprising first and second switch means and an actuator means for contacting and operating a respective one of said switch means in correspondence with the direction of movement of the platform, one of said actuator means or switch means being secured to said platform, the other being secured to the fixed structure.

2. The apparatus of claim 1 wherein said switch means are secured on said movable platform.

3. The apparatus of claim 1 wherein said drive means further comprises a rotatable driven lever means, a housing means on said movable platform supporting said lever means, and transmission rod means including said linkage member connecting said lever means to said rotatable column for converting the rotary movement of said lever means to pivotal movement of the door.

4. The apparatus of claim 3 wherein said platform comprises a tiltable plate and said switch means are operated by particular orientation of said tiltable plate.

5. The apparatus of claim 4 wherein said tiltable plate is positioned perpendicular to the axis of rotation of said lever means.

6. The apparatus of claim 4 wherein said lever means includes an axle and said housing further comprises abutments at opposite sides of said axle for resting on said tiltable plate.

7. The apparatus of claim 4 wherein said tiltable plate includes a wall portion and guide means for guiding the movement of said plate.

8. The apparatus of claim 4 wherein said actuator means is secured to said housing and said first and second switch means comprise two switches straddling said activator or means.

9. The apparatus of claim 1 wherein said drive means comprises a cylinder and piston drive connected to the rotatable column, a holder means articulately journalling said cylinder and wherein said movable platform comprises a tiltable plate, said switch means being operated by particular orientations of said tiltable plate.

10. The apparatus of claim 9 wherein said movable platform further comprises a tilting shaft supporting said tiltable plate, said resilient means being on opposite sides of said tilting shaft for restoring the position of said tiltable plate.

* * * * *